United States Patent [19]

Konno

[11] Patent Number: 4,905,639

[45] Date of Patent: Mar. 6, 1990

[54] VALVE OPERATING APPARATUS FOR AN INTERNAL COMBUSTION ENGINE

[75] Inventor: Tsuneo Konno, Saitama, Japan

[73] Assignee: Honda Giken Kogyo Kabushiki Kaisha, Tokyo, Japan

[21] Appl. No.: 110,843

[22] Filed: Oct. 21, 1987

[30] Foreign Application Priority Data

Oct. 23, 1986 [JP] Japan ..... 61-162400[U]

[51] Int. Cl.[4] ..... F01L 1/18

[52] U.S. Cl. ..... 123/90.16; 123/90.39

[58] Field of Search ..... 123/90.16, 90.17, 90.41, 123/90.39

[56] References Cited

U.S. PATENT DOCUMENTS

| | | | |
|---|---|---|---|
| 1,066,069 | 7/1913 | Willshaw | 123/90.16 |
| 2,829,540 | 4/1958 | Niemeyer | 74/569 |
| 3,299,869 | 1/1967 | Sicklesteel | 123/90.27 |
| 3,722,484 | 3/1973 | Gordini | 123/90.27 |
| 4,151,817 | 5/1979 | Mueller | 123/90.16 |
| 4,203,397 | 5/1980 | Soeters, Jr. | 123/90.16 |
| 4,206,734 | 6/1980 | Perr et al. | 123/502 |
| 4,448,156 | 5/1984 | Henault | 123/90.17 |
| 4,499,870 | 2/1985 | Aoyama | 123/198 F |
| 4,523,550 | 6/1985 | Matsuura | 123/90.16 |
| 4,534,323 | 8/1985 | Kato et al. | 123/90.16 |
| 4,535,732 | 8/1985 | Nakano et al. | 123/90.16 |
| 4,537,164 | 8/1985 | Ajiki et al. | 123/90.16 |
| 4,537,165 | 8/1985 | Honda et al. | 123/90.16 |
| 4,545,342 | 10/1985 | Nakano et al. | 123/198 F |
| 4,567,861 | 2/1986 | Hara et al. | 123/90.16 |
| 4,576,128 | 3/1986 | Kenichi | 123/198 F |
| 4,584,974 | 4/1986 | Aoyama et al. | 123/90.16 |
| 4,589,387 | 5/1986 | Miura et al. | 123/198 F |
| 4,612,884 | 9/1986 | Ajiki et al. | 123/90.16 |
| 4,615,307 | 10/1986 | Kodama et al. | 123/90.16 |
| 4,656,977 | 4/1987 | Nagahiro et al. | 123/90.16 |
| 4,690,110 | 9/1987 | Nishimura et al. | 123/90.17 |
| 4,727,831 | 3/1988 | Nagahiro et al. | 123/90.16 |

FOREIGN PATENT DOCUMENTS

| | | | |
|---|---|---|---|
| 0186341 | 7/1986 | European Pat. Off. . | |
| 0213758 | 3/1987 | European Pat. Off. . | |
| 3613945 | 10/1986 | Fed. Rep. of Germany . | |
| 611328 | 9/1926 | France | 123/90.44 |
| 1003568 | 3/1952 | France . | |
| 61-19911 | 1/1986 | Japan . | |
| 61-81510 | 4/1986 | Japan . | |
| 61-201807 | 9/1986 | Japan | 123/90.39 |
| 511903 | 8/1939 | United Kingdom . | |
| 1399813 | 7/1975 | United Kingdom . | |
| 2054036 | 2/1981 | United Kingdom . | |
| 2066361 | 7/1981 | United Kingdom . | |
| 2141172 | 12/1984 | United Kingdom . | |
| 2159877 | 12/1985 | United Kingdom . | |
| 2185784 | 7/1987 | United Kingdom . | |

*Primary Examiner*—Andrew M. Dolinar
*Attorney, Agent, or Firm*—Lyon & Lyon

[57] ABSTRACT

Valve operating apparatus is disclosed in which the valves are operated by transmitting members in the form of rocker arms or bucket lifters driven by cams having different cam profiles and coupling devices for selectively connecting or disconnecting adjacent transmitting members to vary the operation of the valves under different engine operating conditions. The transmitting member that is not directly associated with a valve and that idles when not coupled to an adjacent transmitting member is spring biased toward the operating cam by an abutment member and means are provided to limit the stroke of the abutment member.

7 Claims, 5 Drawing Sheets

FIG. 2.
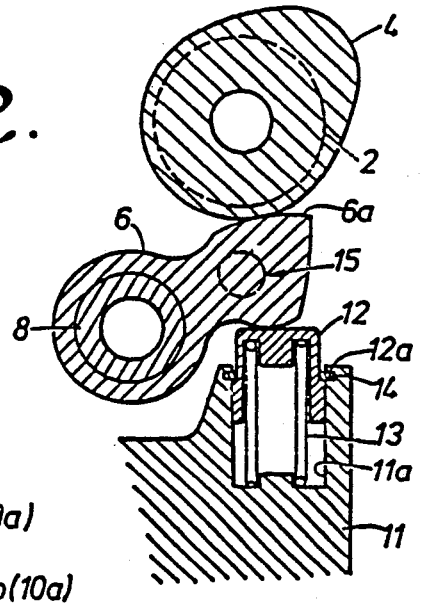
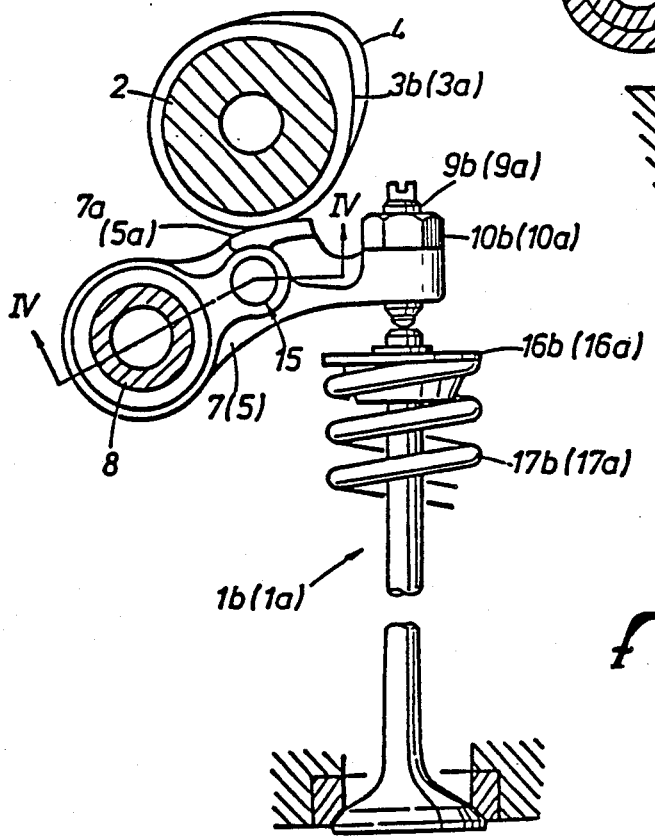
FIG. 3.

VALVE OPERATING APPARATUS FOR AN INTERNAL COMBUSTION ENGINE

BACKGROUND OF THE INVENTION

The present invention relates to valve operating apparatus for an internal combustion engine. More particularly, the invention relates to apparatus effective to vary the operational characteristics of intake or exhaust valves in an internal combustion engine during various operating ranges of the engine.

The combustion chambers of a four-cycle engine have intake and exhaust valves for supplying an air-fuel mixture into, and discharging a burned gas from, the combustion chambers according to prescribed cycles. These intake and exhaust valves are normally urged in a closing direction by valve springs disposed around the respective valve stems. The intake and exhaust valves are adapted to be forcibly opened against the bias of the valve springs by cams integrally formed on a camshaft which is driven by the crankshaft of the engine through a belt and pulleys, or the like.

There have been proposed various devices wherein a plurality of intake valves or exhaust valves are disposed in each cylinder of an engine, and wherein, during low-speed operation of the engine, one of the intake or exhaust valves is operated, while, during high-speed operation, all of the valves are operated, and, at the same time, the operation timing of the valves is varied dependent on the engine rotational speed. With this arrangement, the efficiency with which an air-fuel mixture is charged into a combustion chamber can be increased over a wide range of engine operation. One such device is described in Japanese Laid-Open Patent Publication No. 61-19911 that is assigned to the assignee of the present application. This prior art publication discloses, as a device for changing the valve operation timing, a device for disabling the valve operation of an internal combustion engine, including a camshaft rotatable in synchronism with the rotation of an engine and having an integral low-speed cam aligned with one of the intake or exhaust valves and having a cam profile corresponding to low-speed operation of the engine and an integral high-speed cam having a cam profile corresponding to high-speed operation of the engine, a rocker shaft, a first rocker arm angularly movably supported on the rocker shaft and held in sliding contact with the low-speed cam and engageable with said one intake or exhaust valve, a second rocker arm angularly movably supported on the rocker shaft and engageable with the other intake or exhaust valve, a third rocker arm held in sliding contact with the high-speed cam, the first, second, and third rocker arms being relatively angularly displaceable in mutual sliding contact, and having coupling means for selectively interconnecting the first, second, and third rocker arms and allowing these rocker arms to be relatively angularly displaced. The coupling device includes pistons slidably fitted in guide holes disposed in the rocker arms in mutual communication, the pistons being hydraulically operable to interconnect the rocker arms, as disclosed in the specification of the above publication. In this known structure, the third rocker arm, which is held in sliding contact with the high-speed cam, is angularly moved by that cam at all times. The third rocker arm transmits the lifting movement of the cam to the valves, however, only when the rocker arms are interconnected. When the rocker arms are disconnected, the third rocker arm moves only idly.

Characteristically in such devices, while the first and second rocker arms held in sliding contact with the low-speed cam are always kept in sliding contact with that cam by valve springs, the third rocker arm is maintained in sliding contact with the high-speed cam by a lifter device when the rocker arms are disconnected. The biasing force imposed by the lifter device is, therefore, of a critical nature. More specifically, if this biasing force is too small, it cannot limit the inertial motion of the rocker arms during high-speed operation. If the biasing force is too large, on the other hand, increased friction due to the pushing force against the third rocker arm will result. In particular, it has been found that, since the coupling device is operated at the base-circle portions of the cams, undue biasing forces applied at the base-circle portions of the cams will accelerate wear on the high-speed cam or the cam slipper of the high-speed rocker arm at a rate higher than the rate of wear on the low-speed cam.

In view of the aforesaid drawbacks of the prior art, it is a primary object of the present invention to provide a device for changing the valve operation timing of an internal combustion engine, the device being improved so as to be capable of appropriately limiting biasing forces applied to an idly moving rocker arm for pushing the same against a cam surface.

SUMMARY OF THE INVENTION

According to the present invention, the above object is accomplished by providing a device for changing the valve operation timing of an internal combustion engine having a camshaft rotatable in synchronism with a crankshaft and having integral first and second cams containing cam profiles according to the operating speed ranges of the engine; valves disposed in intake or exhaust ports of a combustion chamber, normally urged by spring means so as to be closed, and drivable by the cams so as to be opened; a first transmitting member held in sliding contact with the first cam for transmitting lifting movement thereof to the valves; a second transmitting member held in sliding contact with the second cam for transmitting lifting movement thereof to the valves; and a coupling device for selectively interconnecting and disconnecting the first and second transmitting members, characterized in that the first transmitting member transmits the lifting movement of either one of the first or second cams directly to the valves dependent on the operating condition of the coupling device; the second transmitting member transmits the lifting movement of the second cam to the valves only when the transmitting members are interconnected, and idly moves when the transmitting members are disconnected; and the second transmitting member has means for urging itself in a direction toward an outer peripheral surface of the second cam including means for limiting the stroke of the urging means in such direction.

In accordance with this arrangement, the stroke of the urging means is limited when the second transmitting member idles. For example, during idling the pressure of contact between the second transmitting member and the second cam is substantially eliminated at the base-circle portion of the cam.

BRIEF DESCRIPTION OF THE DRAWINGS

FIG. 2 is a sectional view taken along line II—II of FIG. 1;

FIG. 3 is an elevational view, partly in section, as viewed in the direction of the arrow III in FIG. 1;

DESCRIPTION OF THE PREFERRED EMBODIMENT

Figure 1:
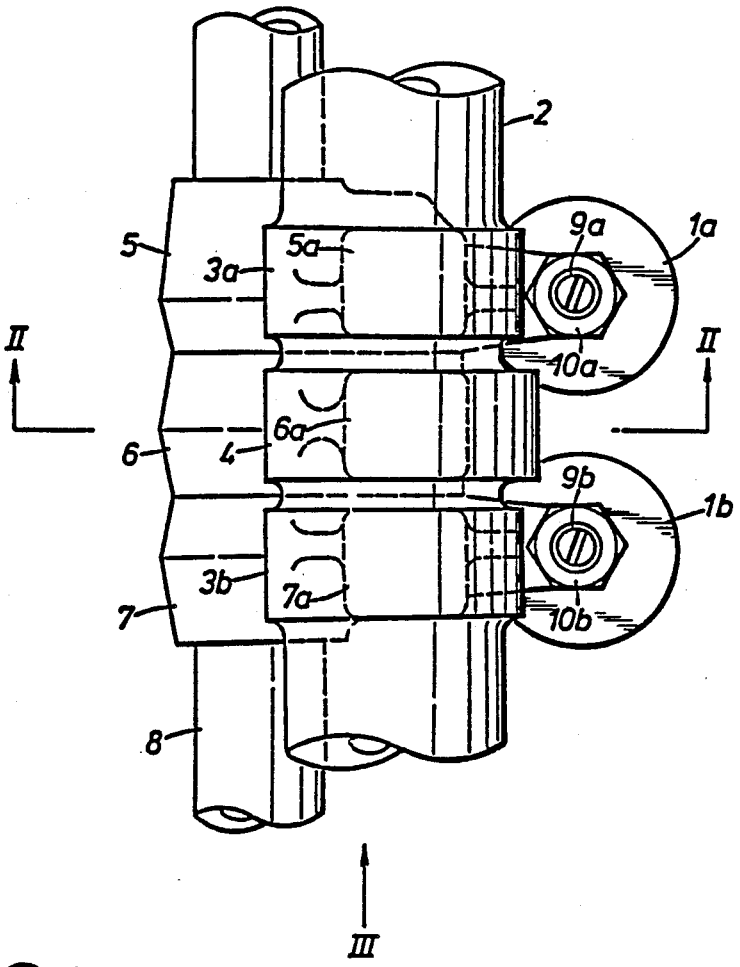
FIG. 1 is a plan view of a device for changing valve operation timing in accordance with a first embodiment of the present invention.

With reference to FIG. 1, an internal combustion engine body (not shown) has a pair of intake valves 1*a*, 1*b*, which can be opened and closed by the coaction of a pair of low-speed or first cams 3*a*, 3*b* and a single high-speed or second cam 4. The cams 3*a*, 3*b* and 4 are of egg-shaped cross section and are integrally formed on a camshaft 2 synchronously rotatable at a speed ratio of ½ with respect to the speed of rotation of a crankshaft (not shown). First and third rocker arms or first transmitting members 5, 7 and a second rocker arm or second transmitting member 6 are swingable in engagement with the cams 3*a*, 3*b*, 4. The internal combustion engine also has a pair of exhaust valves (not shown) which may be opened and closed in the same manner as the intake valves 1*a*, 1*b*.

The first through third rocker arms 5 through 7 are pivotally supported adjacent to each other on a rocker shaft 8 positioned below the camshaft 2 and extending parallel thereto. The first and third rocker arms 5, 7 are basically of the same shape and have their base portions pivotally supported on the rocker shaft 8 and free ends extending above the respective intake valves 1*a*, 1*b*. Tappet screws 9*a*, 9*b* are adjustably threaded through the free ends of the rocker arms 5, 7 and are held against the upper ends of the intake valves 1*a*, 1*b*. The tappet screws 9*a*, 9*b* are locked against being loosened by means of lock nuts 10*a*, 10*b*, respectively.

The second rocker arm 6 is pivotally supported on the rocker shaft 8 between the first and third rocker arms 5, 7 and extends slightly from the rocker shaft 8 toward an intermediate position between the intake valves 1*a*, 1*b*. As better shown in FIG. 2, the second rocker arm 6 has a cam slipper 6*a* on its upper surface which is held in sliding contact with the high-speed cam 4. A lifter 12, slidably fitted in a guide hole 11*a* defined in a cylinder head 11, has an upper end held against the lower surface of the end of the second rocker arm 6. The lifter 12 is normally urged upwardly by a coil spring 13 disposed under compression between the inner surface of the lifter 12 and the bottom of the guide hole 11*a*, thereby enabling the cam slipper 6*a* of the second rocker arm 6 to follow the outer peripheral surface of the high-speed cam 4.

The lifter 12 has a smaller-diameter upper portion defining a step 12*a* therebeneath which is held against a stop ring 14 fitted in the guide hole 11*a* near its open end for limiting the upward stroke of the lifter 12.

The camshaft 2 is rotatably supported above the engine body, as described above, the low-speed cams 3*a*, 3*b* are integrally formed on the camshaft 2 in alignment with the first and third rocker arms 5, 7, and the high-speed cam 4 is integrally formed thereon in alignment with the second rocker arm 6. As better illustrated in FIG. 3, the low-speed cams 3*a*, 3*b* have their respective outer peripheral surfaces held in sliding contact with cam slippers 5*a*, 7*a*, respectively, on the upper surface of the first and third rocker arms 5, 7. The lifter 12 is omitted from illustration in FIG. 3. The first through third rocker arms 5 through 7 are switchable between a condition in which they can swing together and a condition in which they are relatively angularly displaceable by a coupling device 15 mounted in holes disposed centrally through the rocker arms 5 through 7 parallel to the rocker shaft 8.

Retainers 16*a*, 16*b* are disposed on the upper portions of the respective intake valves 1*a*, 1*b*. Valve springs 17*a*, 17*b* are interposed between the retainers 16*a*, 16*b* and the engine body and disposed around the stems of the intake valves 1*a*, 1*b* for normally urging the valves in a closing direction, i.e., upwardly as illustrated in FIG. 3.

Figure 4:
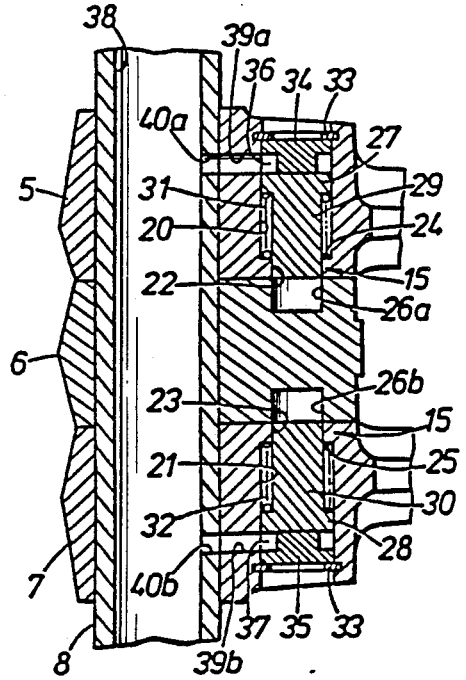
FIG. 4 is a sectional view taken along line IV—IV of FIG. 3 illustrating the position of the parts during low-speed operation.
Figure 5:
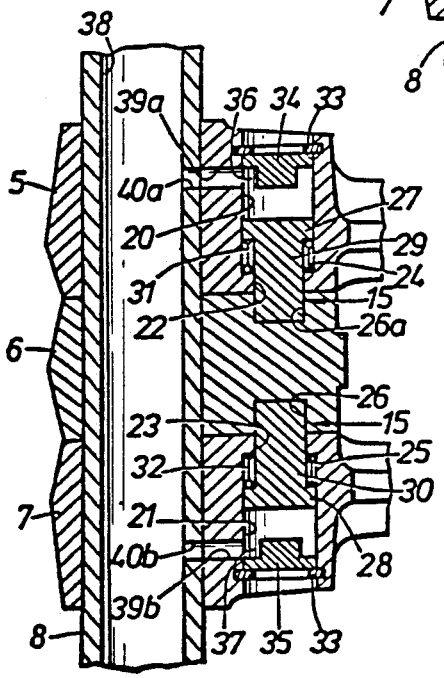
FIG. 5 is a view similar to FIG. 4, illustrating the position of the parts during high-speed operation.

As shown in FIGS. 4 and 5, the first and third rocker arms 5, 7 have guide holes 20, 21 defined therethrough between opposite sides thereof parallel to the rocker shaft 8. The first and third rocker arms 5, 7 also have smaller-diameter holes 22, 23 defined at the inner ends of the guide holes 20, 21 with steps 24, 25 therebetween. The second rocker arm 6 has guide recesses 26*a*, 26*b* disposed on opposite sides thereof and opening toward the guide holes 20, 21 of the first and third rocker arms 5, 7, respectively.

Pistons 29, 30 are disposed in the respective guide holes 20, 21 with the forward ends thereof slidably fitted in the respective smaller-diameter holes 22, 23. The rear end of the pistons 29, 30 are provided with larger-diameter steps 27, 28. The pistons 29, 30 are normally urged to move into the guide holes 20, 21, by means of coil springs 31, 32 that are placed under compression between the larger-diameter steps 27, 28 on the respective pistons and the steps 24, 25 formed in the respective guide holes 20, 21. Caps 34, 35 are fitted in the outer ends of the respective guide holes 20, 21 and retained in place by stop rings 33 to prevent the pistons 29, 30 from being dislodged out of the guide holes 20, 21.

The axial dimension of each of the pistons 29, 30 is selected such that when one end thereof abuts against the adjacent cap, 34 or 35, the other end does not project from the end of the respective guide holes 20 or 21.

The caps 34, 35 are each formed with smaller-diameter inner ends providing air gaps 36, 37 between the outer ends of the pistons 29, 30 and the caps 34, 35. The rocker shaft 8 has a hydraulic passage 38 communicating with a hydraulic pressure supply device (not shown) for supplying working oil at all times into the air gaps 36, 37 through hydraulic passages 39*a*, 39*b* defined in the first and third rocker arms 5, 7 in communication with the air gaps 36, 37, and holes 40*a*, 40*b* defined in the wall of the rocker shaft 8, irrespective of how the first and third rocker arms 5, 7 are angularly moved.

With reference to FIGS. 4 and 5, the operation is as follows. In the low- and medium-speed operating ranges of the engine, a control valve (not shown) is closed and no hydraulic pressure is supplied to the rocker shaft fluid passage 38, nor to the guide holes 20, 21 of the coupling device 15. The pistons 29, 30 are thus each disposed in their retracted position in the respective guide holes 20, 21 under the biasing force of the respective coil springs 31, 32 as shown in FIG. 4. Therefore, the rocker arms 5 through 7 are angularly movable relative to each other.

In the condition where the rocker arms are disconnected by the coupling device 15, the first and third rocker arms 5, 7 are moved in sliding contact with the low-speed cams 3*a*, 3*b* in response to rotation of the camshaft 2, and the opening timing of the intake valves 1*a*, 1*b* is delayed and the closing timing thereof is advanced, with the lift thereof being reduced. At this time, the second rocker arm 6 is angularly moved in sliding contact with the high-speed cam 4, but such angular movement does not affect operation of the intake valves 1*a*, 1*b* in any way.

On the other hand, when the engine is to operate in a highspeed range, the control valve is opened to supply working oil pressure to the fluid passage 38 and thence to the air gaps 36, 37 of the guide holes 20, 21 through the hydraulic passages 39*a*, 39*b* and the holes 40*a*, 40*b*. As shown in FIG. 5, the pistons 29, 30 are thereby caused to move into the second rocker arm 6 against the bias of the coil springs 31, 32. As a result, the inner ends of the pistons 29, 30 project into the respective guide recesses 26*a*, 26*b* of the second rocker arm 6 whereupon the first through third rocker arms 5 through 7 are interconnected.

With the first through third rocker arms 5 through 7 being thus interconnected by the coupling device 15, the first and third rocker arms 5, 7 are caused to be angularly moved in unison with the second rocker arm 6, since the extent of swinging movement of the second rocker arm 6 in sliding contact with the high-speed cam 4 is largest. Accordingly, with the device in this condition the opening timing of the intake valves 1*a*, 1*b* is advanced and the closing timing thereof is delayed and the lift thereof is increased according to the cam profile of the high-speed cam 4.

Figure 6:
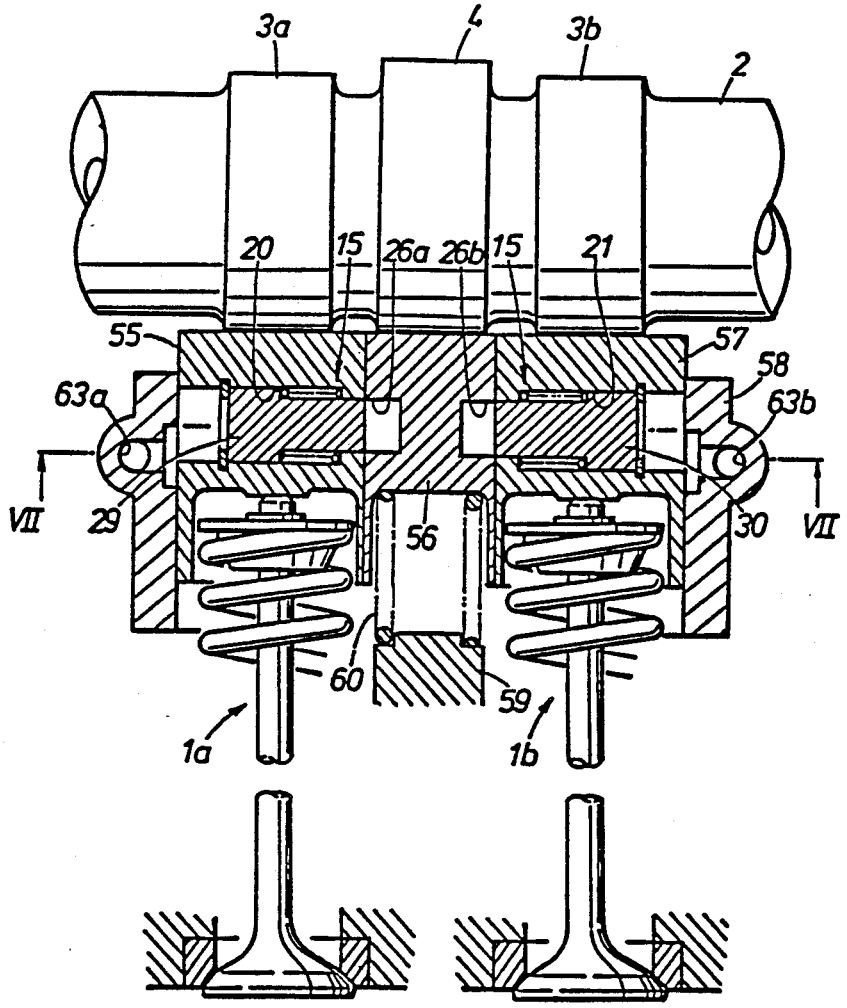
FIG. 6 is an elevational view, partly in section, of a valve operating mechanism according to a second embodiment of the present invention.

FIGS. 6 through 9 show a second embodiment of the present invention in which the rocker arm transmitting members of the previous embodiment are replaced by an arrangement of bucket lifters. As shown in FIG. 6, a pair of intake valves 1*a*, 1*b* can be opened and closed by the coaction of a pair of low-speed cams 3*a*, 3*b* and a single high-speed cam 4 which are of egg-shaped cross section, with first through third transmitting members in the form of bucket lifters 55 through 57 that move linearly in engagement with the cams 3*a*, 3*b*. 4.

The first through third bucket lifters 55 through 57 are slidably accommodated adjacent to each other in a guide block 58 disposed on the engine body below the camshaft 2. The first and third bucket lifters 55, 57 are basically of the same shape and have upper surfaces held in sliding contact with the low-speed cams 3*a*, 3*b*, respectively. The first and third bucket lifters 55, 57 include lower skirt portions having inner surfaces engaging the upper ends of the respective intake valves 1*a*, 1*b*.

The second bucket lifter 56 is supported in the guide block 58 between the first and third bucket lifters 55, 57, being slidably movable with respect thereto. The second bucket lifter 56 has a lower skirt portion and an upper surface that is held in sliding contact with the high-speed cam 4. The second bucket lifter 56 is normally urged upwardly so as to remain in sliding contact with the high-speed cam 4 by a coil spring 60 placed under compression between the inner surface of the lower skirt portion of the second bucket lifter 56 and a spring seat 59 formed integral with the engine body.

Figure 7:
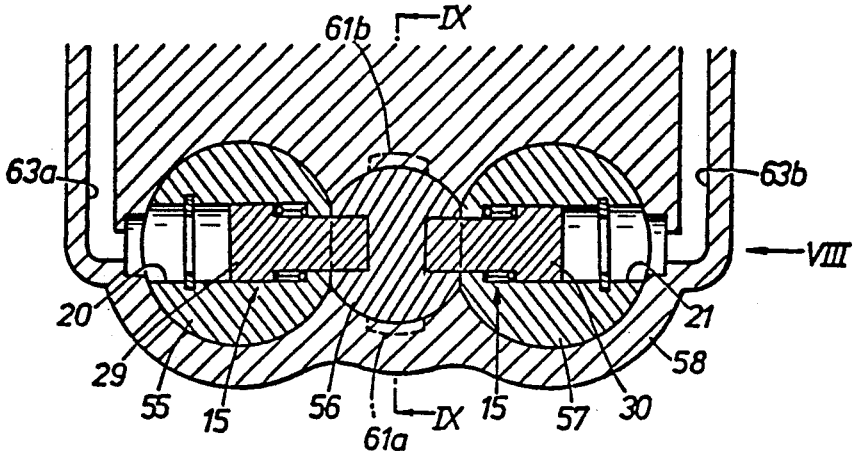
FIG. 7 is a sectional view taken along line VII—VII of FIG. 6, illustrating the position of the parts of the second embodiment during high-speed operation.

The first through third bucket lifters 55 through 57 have mutually engaging slidable side wall surfaces which, as illustrated in FIG. 7, are ground flatwise. The first through third bucket lifters 55 through 57 are thus prevented from turning circumferentially with respect to each other within the guide block 58.

Figure 9:
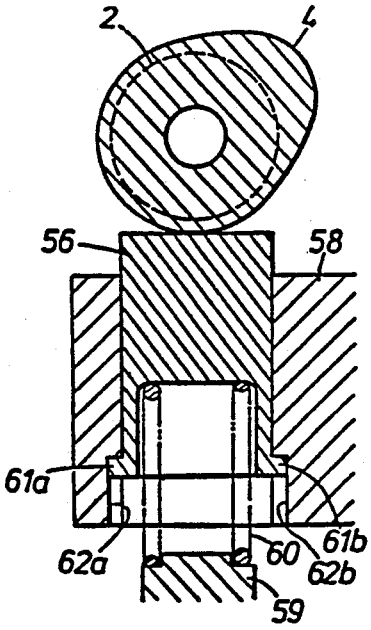
FIG. 9 is a sectional view taken along line IX—IX of FIG. 7.
Figure 8:
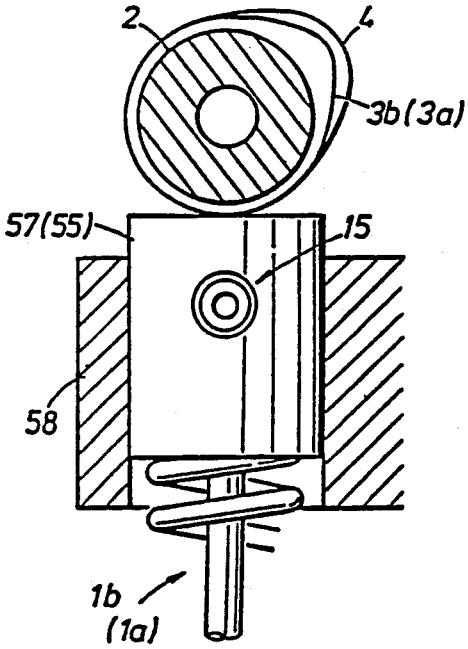
FIG. 8 is an elevational view, partly in section, as viewed in the direction of the arrow VIII in FIG. 7.

As shown in FIGS. 7 and 9, the lower end of the second bucket lifter 56 has a pair of diametrically opposite teeth 61*a*, 61*b* projecting radially outwardly and engaging in respective recesses 62*a*, 62*b* defined in inner surfaces of the guide block 58 for limiting the upward stroke of the second bucket lifter 56.

The camshaft 2 is rotatably supported above the engine body and has integral low-speed cams 3*a*, 3*b* aligned with the first and third bucket lifters 55, 57, respectively, and an integral high-speed cam 4 aligned with the second bucket lifter 56. The first through third bucket lifters 55 through 57 are switchable between a position in which they are slidable together and a position in which they are relatively displaceable by a coupling device 15 that is similar to the coupling device according to the first embodiment.

As shown in FIGS. 6 and 7, the coupling device 15, which is of a construction that is substantially identical to that of the coupling device of the first embodiment, is disposed in upper portions of the bucket lifters 55 through 57. However, the caps 34, 35 of the first embodiment are dispensed with, and hydraulic pressure is applied to the outer ends of pistons 29, 30 via hydraulic passages 63*a*, 63*b* defined in the guide block 58 in communication with the outer ends of the guide holes 20, 21 defined in the respective bucket lifters 55, 57.

By applying working oil pressure to, and releasing the same from, the pistons 29, 30 through the hydraulic passages 63*a*, 63*b*, the inner ends of the pistons 29, 30 can be moved into and out of guide recesses 26*a*, 26*b*, respectively, defined in the second bucket lifter 56 for selectively interconnecting and disconnecting the bucket lifters 55, 56, 57.

In each of the first and second embodiments, the second bucket lifter (second rocker arm) held in sliding contact with the high-speed cam 4 is spring-loaded irrespective of the biasing forces of the valve springs when the bucket lifters or rocker arms are disconnected. Since the upward stroke of the lifter is limited as described above, however, undue pushing forces larger than required are prevented from being applied to the cam surface of the high-speed cam.

The two valves combined with the three transmitting members are simultaneously operated in the above embodiments. However, the present invention is equally applicable to a valve operation timing changing device for disabling one of the valves at a certain engine rotational speed, or such a device for changing the operation timing of a single valve with two transmitting members.

It will be appreciated that, by means of the present invention, it is possible to appropriately limit the contact pressure which the second transmitting member applies to the associated cam surface while the second transmitting member is moving in an idling mode. Since the positional accuracy of the second transmitting member during operation of the coupling device is increased, operational reliability of the coupling device is improved, and friction can effectively be reduced.

While the present invention has been described herein in relation to intake valves it should be understood that the present invention is equally applicable to exhaust valves. Moreover, it should be further understood that, although a preferred embodiment of the invention has been illustrated and described herein, changes and modifications can be made in the described arrangement without departing from the scope of the appended claims.

I claim:

1. Operating apparatus for a valve for an internal combustion engine including a camshaft rotatably driven by said engine, a first transmitting member operably engaging a first cam on said camshaft; a second transmitting member operably engaging a second cam on said camshaft; a coupling device for selectively interconnecting and disconnecting said first and second transmitting members for independent movement or movement in unison; said second transmitting member being adapted for idling movement with said coupling device in its disconnecting mode; means for biasing said second transmitting member against said second cam including a stationary base subjacent said second transmitting member; an abutment member movable in a direction between said base and said second transmitting member; spring means for biasing said abutment member against said second transmitting member; and shoulder means on said abutment member and said base cooperable to limit the extent of movement of said abutment member against said transmitting member.

2. The valve operating apparatus according to claim 1 in which said transmitting members are rocker arms mounted for pivotal movement on a rocker shaft.

3. Operating apparatus for at least one valve of an internal combustion engine, comprising:

a cam shaft rotatably by said engine;

first and second cams fixed to said camshaft for rotation therewith, each of said cams having cam profiles according to respective operating ranges of said engine;

spring means for normally urging said at least one valve to a closed condition, said at least one valve being driven by said cams to an open condition;

a first transmitting member disposed in sliding contract with said first cam for transmitting the operating movement of said first cam to said at least one valve;

a second transmitting member disposed in sliding contact with said second cam for transmitting the operating movement of said second cam to said at least one valve;

a coupling device for selectively interconnecting and disconnecting said first and second transmitting members;

said first transmitting member being operable to transmit the operating movement of either of said cams to at least one valve dependent on the operating condition of said coupling device;

said second transmitting member being operable to transmit the operating movement of said second cam to said at least one valve only when said coupling device interconnects said transmitting members and to move idly when said transmitting members are disconnected;

means for biasing said second transmitting member toward said second cam; and means for limiting the extent of bias of said biasing means toward said second cam.

4. The valve operating apparatus according to claim 3 in which said biasing means includes a stationary base, a guide bore in said base, a body movable in said guide bore toward and away from said second cam, and spring means for biasing said body toward said second cam.

5. The valve operating apparatus according to claim 4 in which said limiting means comprises shoulder means in said body and said base cooperable to limit the extent of movement of said body toward said second cam.

6. The valve operating apparatus according to claim 3 in which said transmitting members are rocker arms mounted for pivotal movement on a rocker shaft.

7. The valve operating apparatus according to claim 3 in which said transmitting members are bucket lifters engagable with said cams for reciprocating movement in a guide block.

* * * * *